United States Patent [19]

Bolger

[11] Patent Number: 5,018,443

[45] Date of Patent: May 28, 1991

[54] POSITION SENSOR SYSTEMS FOR A PRINT HEAD

[75] Inventor: Richard P. Bolger, Schaumburg, Ill.

[73] Assignee: Illinois Tool Works Inc., Glenview, Ill.

[21] Appl. No.: 407,631

[22] Filed: Sep. 15, 1989

[51] Int. Cl.[5] ..... B41F 33/00

[52] U.S. Cl. ..... 101/228; 101/235

[58] Field of Search ..... 101/35, 41, 44, 42, 101/43, DIG. 30, 228, 235, 233, 234, 236, 237, 238, 239

[56] References Cited

U.S. PATENT DOCUMENTS

| | | | |
|---|---|---|---|
| 3,394,651 | 7/1968 | Ochs | 101/35 |
| 3,611,920 | 10/1971 | Timko et al. | 101/35 |
| 4,220,084 | 9/1980 | MacLean et al. | 101/235 |
| 4,334,471 | 6/1982 | Noyes et al. | 101/235 X |

*Primary Examiner*—Clifford D. Crowder

*Attorney, Agent, or Firm*—Thomas W. Buckman; John P. O'Brien; Donald J. Breh

[57] ABSTRACT

A position sensor system for controlling accurately the movement of a print head so that printing occurs on a series of products at the same location independent of product speed, changes in speed and mechanical delays includes a product or product mark sensor, a speed sensor, an integrator, and a comparator. The product mark sensor detects the presence of a product mark on each product to be printed upon to generate sensed signals. The speed sensor detects the speed of the product to be printed upon to generate a speed signal. The integrator is responsive to the speed signal and the sensed signals for generating a ramp signal indicative of the actual position of the product to be printed upon. The comparator compares the ramp signal with a reference signal compensating for mechanical delays and generates a clutch-on signal to activate a print head clutch to cause movement of the print head into a printing position.

20 Claims, 6 Drawing Sheets

LED3
+15V
R123
Q16
IC17C
43a
IC17D
R124
D24
R125
C43
D27
D25
D26
+15V
C44
LED4
+15V
36a
IC17A
R126
Q17
C45
IC17B
R127
LED1
+15V
IC5C
R42
Q6
43
IC5D
R44
D1
R43
+15V
R45
C12
+15V
D2
D3
D4
+15V
C13
R55
LED2
+15V
36
IC5A
R56
Q9
D7
D28
C15
C16
IC5B
+15V
+34V
R57
Q10
R46
Q7
46
PRINT HEAD CLUTCH
R47
R48
IC6
D5
D6
CLUTCH SW
R68
-34V
-15V

POSITION SENSOR SYSTEMS FOR A PRINT HEAD

BACKGROUND OF THE INVENTION

This invention relates generally to printing apparatus and more particularly, it relates to a position sensor system used with a printing apparatus for controlling accurately the movement of a print head so that printing occurs on a series of products at the same location independent of conveyor speed, changes in speed and mechanical delays.

While there are known in the prior art a number of different types of equipment which have been used to control the movement of a print head, they are typically quite expensive and complicated due to their utilization of various mechanical, electromechanical, and computer control arrangements. Accordingly, there has arisen a need for low cost, easy to manufacture and reliable position sensor system for controlling accurately the movement of a print head. This is accomplished in the present invention by the provision of a product position sensor circuit formed of an accurate integrator for generating an appropriate delay so as to cause engagement of a print head clutch.

SUMMARY OF THE INVENTION

Accordingly, it is a general object of the present invention to provide an improved position sensor system which is relatively simple and economical to manufacture and assemble.

It is an object of the present invention to provide a position sensor system used with a printing apparatus for controlling accurately the movement of a print head.

It is another object of the present invention to provide a position sensor system for controlling accurately the movement of a print head so that printing occurs on a series of products at the same location independent of conveyor speed, changes in speed and mechanical delays.

It is still another object of the present invention to provide a product position sensor circuit formed of an accurate integrator for generating an appropriate delay so as to cause engagement of a print head clutch.

It is yet still another object of the present invention to provide a position sensor system which includes first and second print placement circuits responsive to alternate input signals for determining placement of the print upon a series of products even while the other one is busy.

In accordance with these aims and objectives, the present invention is concerned with the provision of a position sensor system for controlling the movement of a print head so that printing occurs on a series of products at the same location which includes a product sensor or product mark sensor for detecting the presence of a product or product mark for each product to be printed upon to generate input signals and speed sensing means for detecting the speed of the product to be printed upon to generate a speed signal. A steering circuit is provided which is responsive to the input signals for generating alternately first enable signals corresponding to a first one of the alternate ones of the input signals and second enable signals corresponding to a second one of the alternate ones of the input signals.

A first print placement circuit is responsive to the first enable signals and the speed signal for generating a first clutch-on signal to activate a print head clutch to cause movement of the print head into a printing position. A second print placement circuit is responsive to the second enable signals and the speed signal for generating a second clutch-on signal to activate the print head clutch to cause movement of the print head into the printing position even when the first print placement circuit is busy.

In another aspect of the present invention, there is provided an integrator formed of an operational amplifier having an inverting input and an output. A capacitor is connected between the inverting input and the output of the operational amplifier. An input resistor has its one end connected to the inverting input and its other end connected to receive a speed signal. A transistor has its emitter and collector connected between the inverting input and the output of the operational amplifier. The base of the transistor is responsive to input signals indicating the presence of a product or product mark. The output of the operational amplifier generates a ramp signal which is indicative of the actual position of a product to be printed upon.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
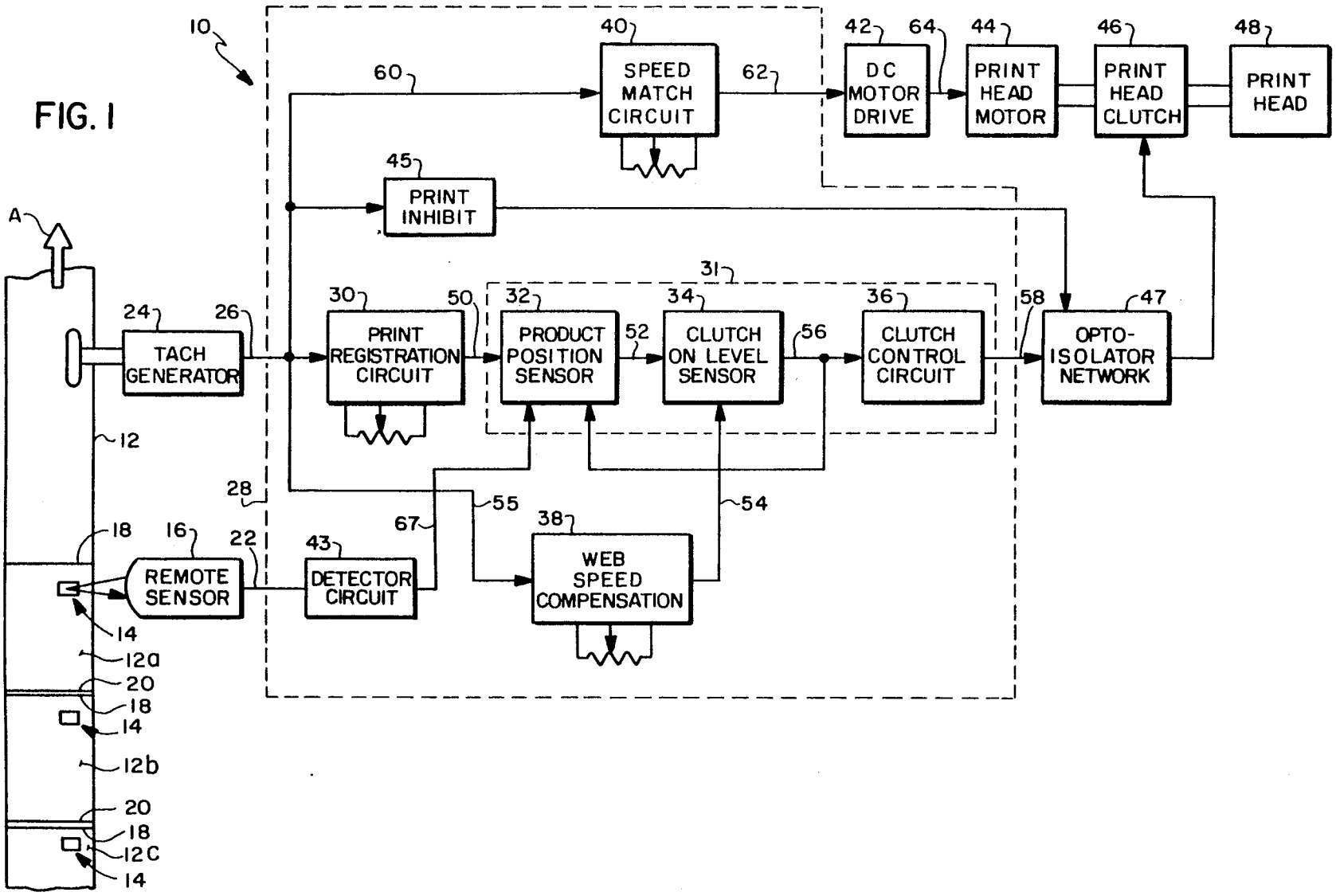
FIG. 1 is a block diagram of a position sensor system constructed in accordance with the present invention.

Referring now in detail to the drawings, there is shown in FIG. 1 a block diagram of a position sensor system 10 of the present invention. A web 12 of material is comprised of a plurality of series-connected products 12*a*, 12*b*, 12*c* . . . which are to be printed upon. The web 12 runs in the direction of arrow A over a conveyor (not shown) driven by drive rollers (not shown). Each of the products is provided at a fixed place with a product mark such as a patch 14. A remote sensor 16 is provided for detecting the passing of each product or product mark, which is needed to indicate that an individual product has been sensed that is to be printed upon. Typically, the product mark 14 is located adjacent the leading edge 18 of each product. Thus, in this manner, actual printing such as a date stamp and the like will occur at the same location between the leading edges 18 and trailing edges 20 of each individual product.

Each time a product or product mark 14 is sensed, the remote sensor 16 will generate a pulse on line 22. In order to measure the speed of the web 12, there is provided a tach generator 24. The output of the tach generator 24 on line 26 is a d.c. level voltage which is directly proportional to the speed of the conveyor or web 12. In other words, when the speed of the web 12 is increased the d.c. level voltage will also be increased.

In addition to the product mark sensing means 16 and speed sensing means 24, the position sensor system 10 is further comprised of control circuitry 28 which includes a print registration circuit 30, a print placement network 31, a web speed compensation circuit 38, and a speed match circuit 40. The print placement network 31 is formed of a product position sensor circuit 32, a clutch-on level sensor circuit 34, and a clutch control circuit 36. The position sensor circuit also includes actuating means consisting of a D.C. motor drive circuit 42, a print head motor 44, a print head clutch 46, and a print head 48.

The print registration circuit 30 receives the d.c. level voltage from the tach generator 24 and provides a modified d.c. level voltage on its output line 50 which is shifted either higher or lower dependent upon where on the individual products the actual printing is to be placed. This modified d.c. level voltage is fed to the input of the product position sensor circuit 32 which is formed of an accurate integrator. The integrator is enabled only when a product mark has been sensed, i.e., a pulse is generated on the line 22. This will cause the output of the integrator to ramp up due to the modified d.c. level voltage. It should be understood that when the web speed is increased, the rate of change of the ramp voltage output will be similarly increased. Thus, the ramp output will indicate the actual position of each individual product.

This ramp voltage is connected via line 52 to one input of the clutch-on level sensor circuit 34 which consists of a comparator. The other input to the comparator is from the output of the web speed compensation circuit 38 on line 54. The web speed compensation circuit 38 also receives the d.c. level voltage from the tach generator 24 via line 55 and shifts this voltage on line 55 proportionally lower for higher web speeds to compensate for fixed mechanical delays. The output of the web speed compensation circuit is a d.c. reference voltage which determines the switching point of the comparator. Normally, the output of the comparator will be at a high logic level. When the ramp voltage exceeds the reference voltage, the output of the comparator will be switched to a low logic level. This low level on line 56 is delivered to the clutch control circuit 36. The output of the clutch control circuit on line 58 being connected to the print head clutch 46 via an opto-isolator network 47 causes the print head motor 44 to be engaged with the print head 48. As a result, the print head 48 will be rotated for printing on the product.

Simultaneously, this low logic level from the comparator on the line 56 will cause the integrator to be reset and will thus begin to charge again on the next sensed product mark. The speed match circuit 40 also receives the d.c. level voltage from the tach generator 24 via line 60 and scales it to provide a speed control signal on line 62. The D.C. motor drive circuit 42 receives the speed control signal so that it can rotate the print head motor 44 via line 64 at the same speed as the web 12. Normally, the print head clutch 46 causes the print head motor 44 to be disengaged from the print head 48. When the print head clutch 46 receives the clutch-on signal via the clutch control circuit 36 and opto-isolator network 47, the print head motor 44 will be engaged with the print head 48.

Figure 2:
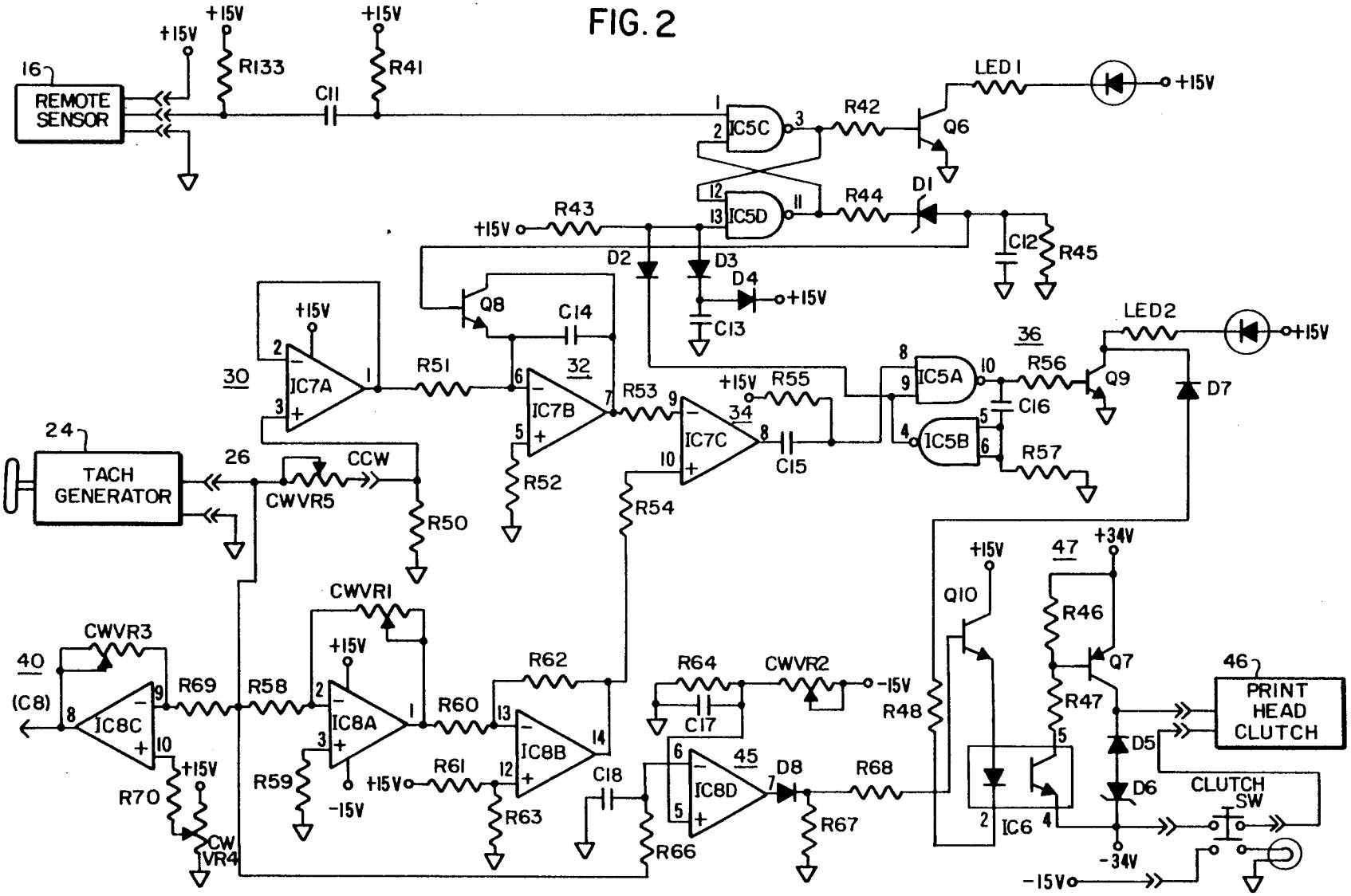
FIG. 2 is a detailed schematic circuit diagram of the position sensor system of FIG. 1.

In FIG. 2, there is shown a detailed circuit diagram of the position sensor system 10 of FIG. 1. The print registration circuit 30 includes a voltage divider and a voltage follower. The voltage divider is formed of a print registration potentiometer VR5 and a resistor R50. The voltage follower is formed of an operational amplifier IC7A. The d.c. level voltage on the line 26 from the tach generator 24 is connected to one end of the potentiometer VR5. The other end of the potentiometer VR5 is connected to one end of the resistor R50 and to the non-inverting input of the operational amplifier IC7A. When the potentiometer VR5 is turned clockwise, printing on the product will occur towards the trailing edge 20. As the potentiometer VR5 is turned counterclockwise, printing on the product will occur sooner and towards the leading edge 18. The output of the operational amplifier IC7A on pin 1 is the modified d.c. level voltage. The product position sensor circuit 32 of the print placement network 31 consists of an accurate integrator which includes an operational amplifier IC7B; resistors R51, R52; capacitor C14; and a switching transistor Q8. The modified d.c level voltage is integrated by the capacitor C14 when the transistor Q8 is turned off. The output of the integrator on pin 7 is a ramp voltage.

The clutch-on level sensor circuit 34 of the print placement network 31 consists of a comparator IC7C; resistors R53, R54; and a differentiator. The differentiator is formed by a resistor R55 and a capacitor C15. The comparator IC7C compares the ramp voltage with the reference voltage from the web speed compensation circuit 38. When the ramp voltage is smaller than the reference voltage, the output of the comparator IC7C on pin 8 will be at a high logic level. When the ramp voltage exceeds the reference voltage, the output of the comparator will be switched to a low logic level. The clutch control circuit 36 of the print placement network 31 includes a monostable multivibrator and a driver circuit. The multivibrator is formed of NAND logic gates IC5A, IC5B; capacitor C16; and resistor R57. The driver circuit is formed of a transistor Q9; a current-limiting resistor R56; and a light-emitting diode LED2. When the output of the comparator is switched to the low logic level, the multivibrator will cause the transistor Q9 to turn on and light the light-emitting diode LED2 indicating that the print head clutch is to be engaged. The output of the clutch control circuit 36 is at the collector of the transistor Q9.

The opto-isolator network 47 includes diodes D5, D6, D7; transistors Q7, Q10; resistors R46, R47, R48; and an optical isolator IC6. When the collector of the transistor Q9 goes low, a positive pulse will appear at the collector of the transistor Q7 defining the output of the opto-isolator network 47. As a result the print head clutch is activated so as to cause the print head motor 44 to be engaged with the print head 48. Thus, the print head will be rotated and printing will occur on the product.

In order to enable the integrator so that it can generate the ramp voltage, the base of the transistor Q8 is connected to receive an enable signal generated from a product mark detector circuit 43. The detector circuit 43 includes a differentiator; a R-S flip-flop; a driver circuit; and a control section. The differentiator is formed by a resistor R41 and a capacitor C11. The R-S flip-flop is formed by the cross-coupled NAND logic gates IC5C, IC5D. The driver circuit is formed by a transistor Q6; a current-limiting resistor R42; and a light-emitting diode LED1. Each time a product mark 14 is sensed by the remote sensor 16, a negative spike will be generated to the input on pin 1 of the NAND gate IC5C. The output of the NAND gate IC5C on pin 3 will cause the transistor Q6 to turn on and thus light the light-emitting diode LED1 indicating that a product has been sensed.

The control section includes diodes D1–D4; capacitors C12, C13; and resistors R43, R44, R45. When the output of the NAND gate IC5C goes high, the output of the NAND gate IC5D goes low so as to turn off the transistor Q8, thereby enabling the integrator. When the ramp voltage exceeds the reference voltage, the output of the comparator will go low. Consequently, the output of the multivibrator on pin 4 of the NAND gate IC5B will go low so as to reset the R-S flip-flop and turn on the transistor Q8, thereby disabling the integrator.

The web speed compensation circuit 38 is comprised of an adjustable gain amplifier and a difference amplifier. The gain amplifier is formed of an operational amplifier IC8A; resistors R58, R59 and a potentiometer VR1. The difference amplifier is formed of an operational amplifier IC8B and resistors R60–R63. The output of the operational amplifier IC8B provides the reference voltage which is fed to the comparator IC7C. The potentiometer VR1 is adjusted so as to scale the d.c. level voltage from the tach generator 24 so as to compensate for the fixed mechanical delays.

The speed match circuit 40 is formed of an operational amplifier IC8C; resistors R69, R70; and potentiometers VR3, VR4. The potentiometer VR4 is adjusted to provide a certain output from the operational amplifier IC8C when the web speed is at zero RPM, thereby reducing the dead time. The potentiometer VR3 is adjusted to synchronize the speed of the print head motor with the speed of the web, thereby avoiding smearing of the printing.

A print inhibit circuit 45 is used to inhibit printing on the product when the web speed decreases below a predetermined speed. This occurs when the conveyor is being turned off. The print inhibit circuit 45 includes a comparator IC8D; diode D8; capacitor C17. C18; resistors R64, R66, R67, R68; and potentiometer VR2. The potentiometer VR2 is adjusted to set the speed below which printing will be inhibited. Normally, the output of the comparator IC8D will be at a high logic level. As a result, the transistor Q10 in the opto-isolator network 47 will be turned on and the opto-isolator network will be rendered operational. When the web speed decreases below the speed set by the potentiometer VR7, the output of the comparator IC8D will be switched to a low level. Consequently, the transistor Q10 will be turned off, thereby disabling the opto-isolator network 47.

Figure 3:
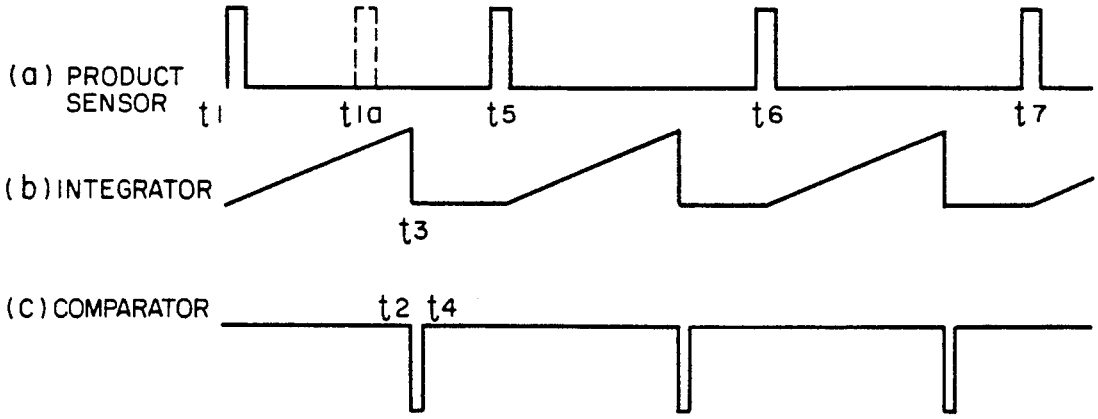
FIGS. 3(*a*)–3(*c*) are waveforms useful in understanding the operation of FIG. 2.

In order to provide an understanding of the operation of the position sensor system 10 of the present invention, reference is now made to FIGS. 3(*a*)–3(*c*) of the drawings which illustrate the waveforms at various points in the system of FIG. 2. Initially, it is assumed that the R-S flip-flop is reset so that pin 11 of the NAND logic gate IC5D is at a high logic level and pin 3 of the NAND logic gate IC5C is at a low logic level. As a result, the light-emitting diode LED1 will be unlit and the transistor Q8 will be turned on. Thus, the output of the operational amplifier IC7B on pin 7 will be zero.

When the first product mark 14 is sensed at time t1 as shown in FIG. 3(*a*), the output on pin 3 of the NAND gate IC5C will make a low-to-high transition. Thus, the light-emitting diode LED1 will be lit indicating that the product mark has been detected. Simultaneously, the transistor Q8 will be turned off so as to enable the charging of the capacitor C14. The output of the operational amplifier IC7B is a ramp voltage which is illustrated in FIG. 3(*b*). When the ramp voltage exceeds the reference voltage determined by the web speed compensation circuit 38, the output of the comparator IC7C will make a high-to-low transition at time t2, The output of the comparator will cause pin 4 of the NAND gate IC5B of the monostable multivibrator to make a high-to-low transition. This, in turn, will cause the R-S flip-flop to reset, which turns off the light-emitting diode LED1 and turns on the transistor Q8. Then, the output of the operational amplifier IC7B will drop to zero volts at time t3. Consequently, the output of the comparator will return to the high logic level at time t4. At the time t2, the transistor Q9 will also be turned on so as to light the light-emitting diode LED2 indicating that the print head clutch is to be engaged. A negative pulse will be further generated from the clutch control circuit 36 for activating the opto-isolator network 47. The opto-isolator network 47 will thus energize the print head clutch 46 so as to cause engagement of the print head motor 44 with the print head 48.

It will be noted that the second, third and fourth product marks are detected at times t5, t6 and t7 respectively. The operation of the various circuits is thus repeated over and over. If the second product mark is sensed at the time t1a as shown in phantom in FIG. 3(*a*), the operational amplifier IC7B in the product sensor circuit 32 would still be occupied or "busy." As a result, the second sensed signal would be "missed" by the position sensor system 10 of the present invention due to the "busy" of the operational amplifier IC7B.

Figure 4:
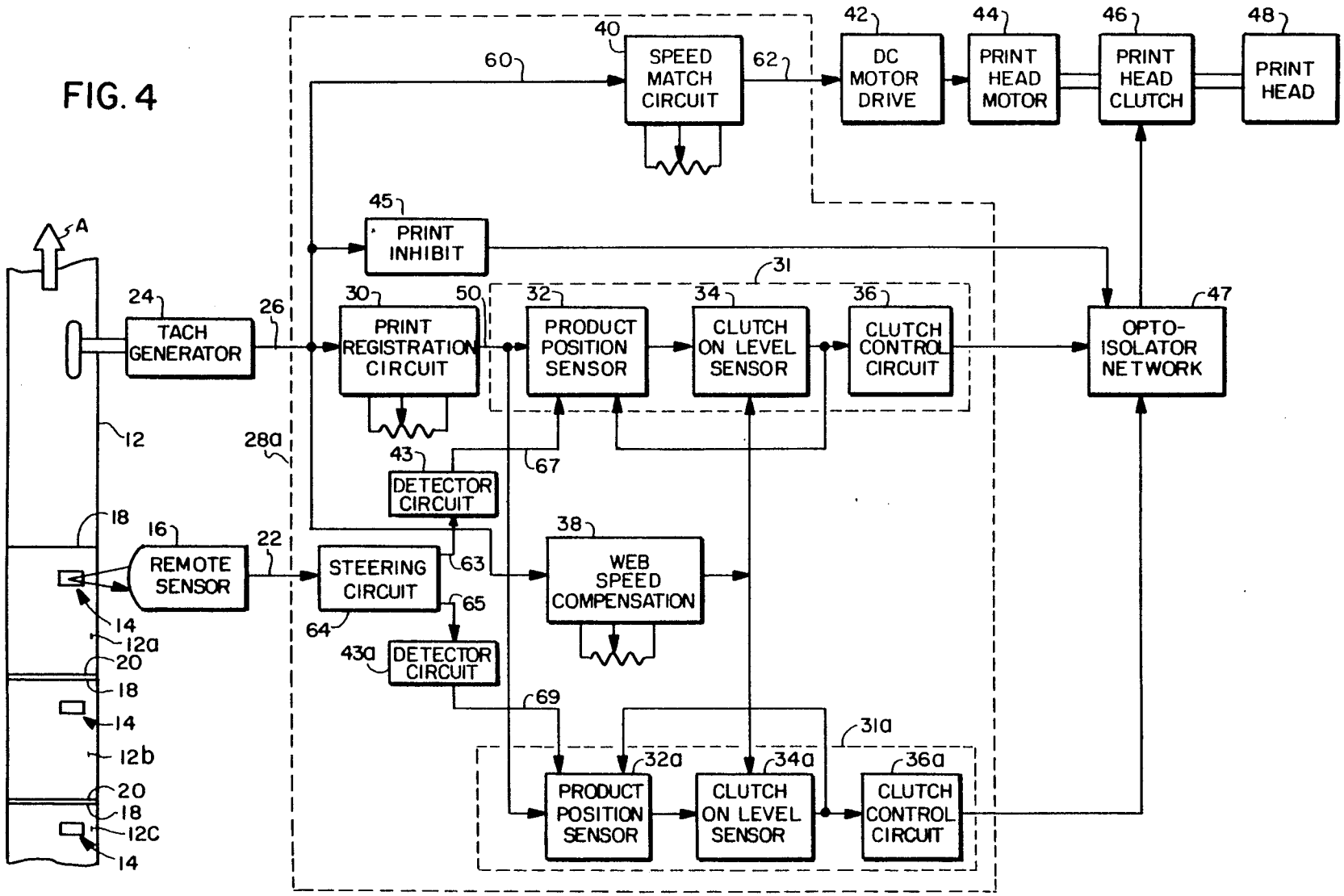
FIG. 4 is a block diagram of a second embodiment of a position sensor system constructed in accordance with the present invention.

In order to overcome this disadvantage, a second embodiment of a position sensor circuit system 10*a* of the present invention is shown in block diagram form in FIG. 4. The position sensor system 10*a* is substantially identical to the position sensor system 10 of FIG. 1 except for a second product mark detector circuit 43*a*, a second print placement network 31*a*, and a steering circuit 64. The second print placement network 31*a* is comprised of a product position sensor 32*a*, a clutch-on level sensor circuit 34*a*, and a clutch control circuit 36*a*, which are identical to the components of the print placement network 31 of FIG. 1. Thus, their detailed interconnection has been purposely omitted.

Figure 5A:
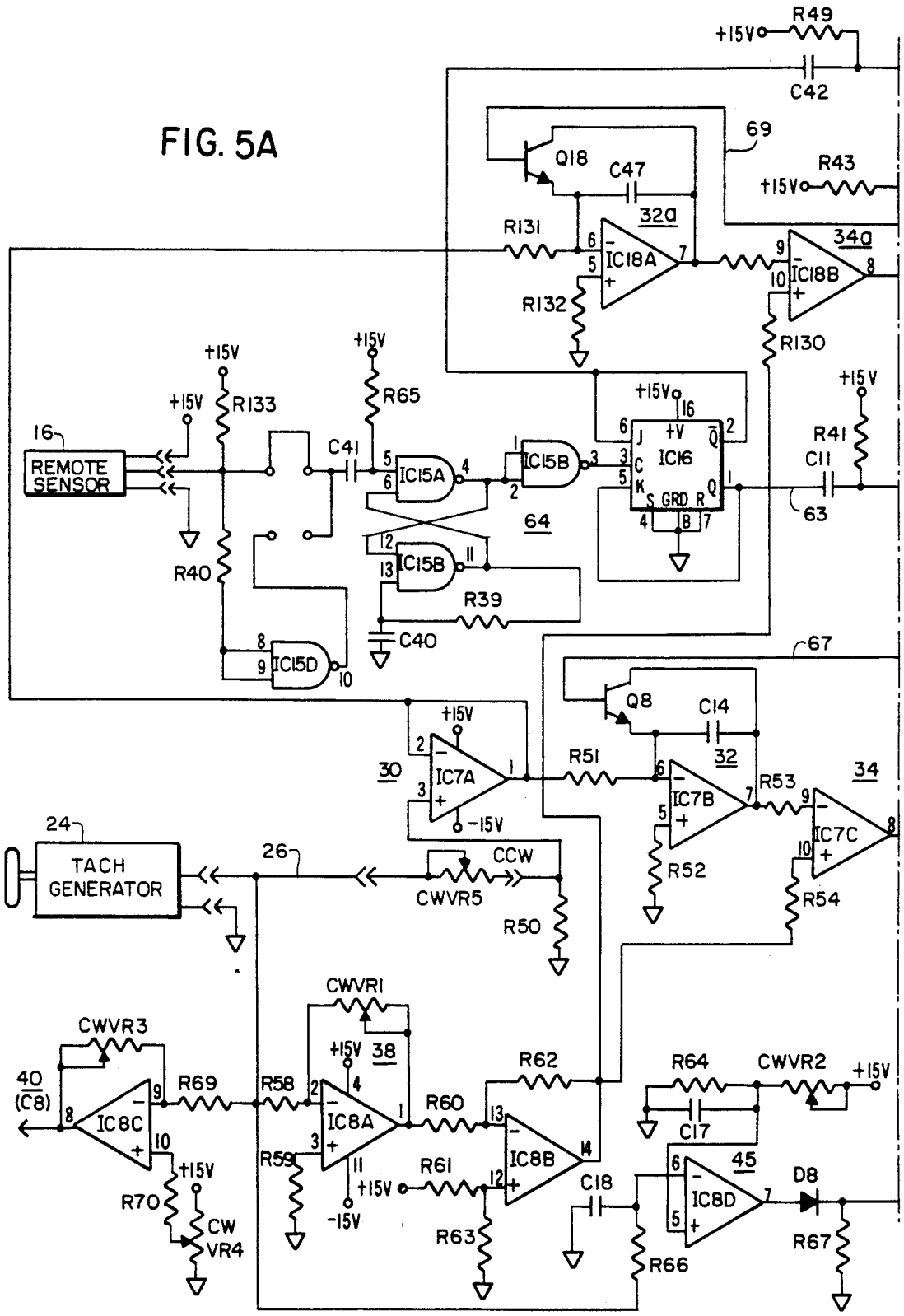
FIGS. 5A and 5B are a detailed circuit diagram of the position sensor system of FIG. 4.
Figure 5B:
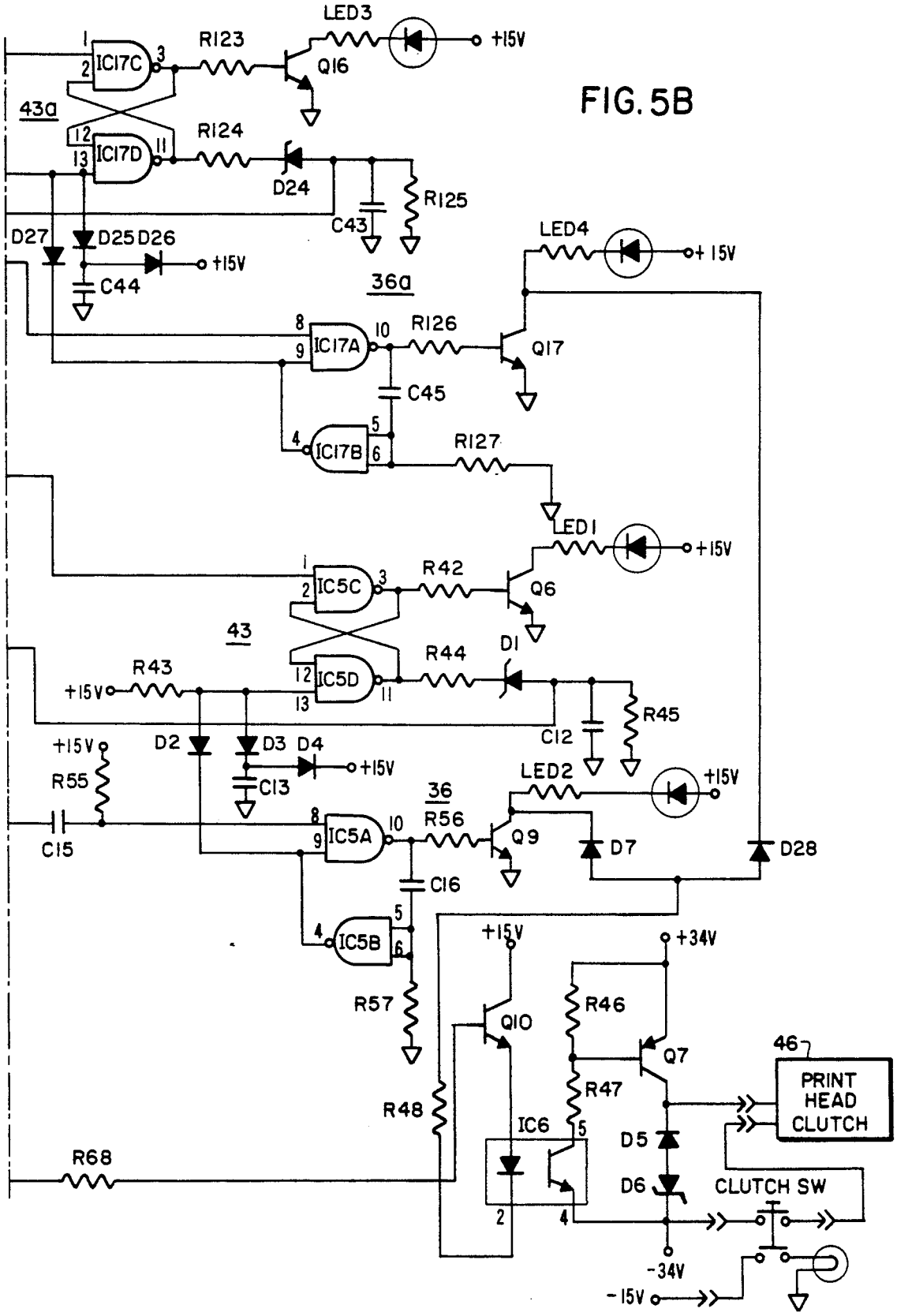

Referring now to FIG. 5 there is shown a detailed schematic circuit diagram of the position sensor system 10*a* of FIG. 4. Only the detailed interconnection of the steering circuit 64 will now be discussed since all of the other components have been previously described with respect to FIG. 2. The steering circuit 64 includes resistors R133, R40; a differentiator; a noise-limiting circuit; an inverter; and a J-K flip-flop. The differentiator is formed by a resistor R65 and a capacitor C41. The noise-limiting circuit consists of a cross-coupled NAND gates IC15A. IC15B; a resistor R39, and a capacitor C40. The inverter is comprised of a NAND logic gate IC15C. The output of the inverter is fed to the clock input of the J-K flip-flop. The Q output of the flip-flop is connected to the input of the first product mark detector circuit 43 via line 63, and the $\overline{Q}$ output of the flip-flop is connected to the input of the second product mark detector circuit 43a via the line 65. The output of the first product detector circuit 43 is connected to the first product position sensor 32 via line 67. The output of the second product detector circuit 43a is connected to the second product position sensor circuit 32a via line 69.

Figure 6:
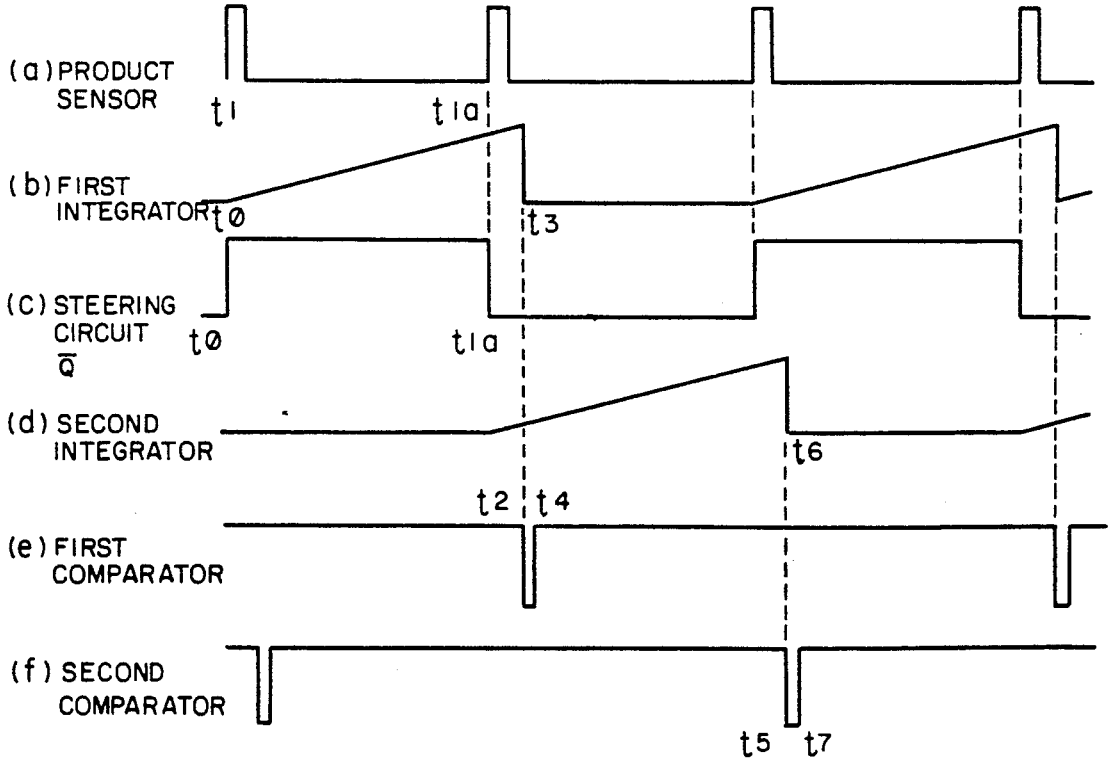
FIGS. 6(*a*)–6(*f*) are waveforms useful in understanding the operation of FIG. 5.

The operation of the position sensor system 10a of FIG. 5 will now be described with reference to the waveforms of FIG. 6(*a*)–6(*f*). Initially, it is assumed that both R-S flip-flops of the respective product mark detector circuit 43 and 43a are reset when the system is first turned on. In other words, pin 11 of the NAND gate IC5D and pin 11 of the NAND gate IC17D will be at a high logic level. Consequently, the light-emitting diodes LED1 and LED2 will be unlit and the transistors Q8, Q18 will both be turned off. Thus, the outputs of the operational amplifiers IC7B and IC18B will be zero at time tϕ. This is shown in FIGS. 6(*b*) and 6(*d*). respectively. Further, it will be assumed that the $\overline{Q}$ output of the J-K flip-flop is at a low logic level at the time tϕ as shown in FIG. 6(*c*).

When the first product mark 14 is detected at time t1 shown in FIG. 6(*a*), the Q output of the J-K flip-flop will make a high-to-low transition. The detector circuit 43 will cause the transistor Q8 to be turned off so as to enable the charging of the capacitor C14. The output of the operational amplifier IC7B is a first ramp voltage which is illustrated in FIG. 6(*b*). It will be noted at time t1a, a second product mark 14 is sensed while the integrator of the first product position sensor circuit 32 is "busy." As can be seen from FIG. 6(*e*), the output of the first comparator of the first clutch-on level sensor circuit 34 is still at a high logic level at this time t1a.

In order to avoid missing the detection of the second product mark 14, the $\overline{Q}$ output of the J-K flip-flop will make a high-to-low transition at this time t1a shown in FIG. 6(*c*). As a result, the second detector circuit 43a will cause the transistor Q18 to be turned on so as to enable charging of the capacitor C47. The output of the operational amplifier IC18A is a second ramp voltage which is illustrated in FIG. 6(*d*). When the first ramp voltage exceeds the reference voltage determined by the web speed compensation circuit 38, the output of the first comparator IC7C will make a high-to-low transition at time t2. The output of the first comparator will cause pin 4 of the NAND gate IC5B of the monostable multivibrator to make a high-to-low transition. This, in turn, will cause the R-S flip-flop of the first detection circuit 43 to reset which turns off the light-emitting diode LED1 and turns on the transistor Q8. Then, the output of the operational amplifier IC7B will drop to zero volts at time t3. Consequently, the output of the first comparator will return to the high logic level at time t4. At the time t2, the transistor Q9 will also be turned on so as to light the light-emitting diode LED2 indicating that the print head clutch 46 is to be engaged. A negative pulse will be further generated from the first clutch control circuit 36 for activating the opto-isolator network 47. The opto-isolator network 47 will thus energize the print head clutch so as to cause engagement of the print head motor 44 with the print head 48 and printing will occur.

Similarly, when the second ramp voltage exceeds the reference voltage, the output of the second comparator IC18B will make a high-to-low transition at time t5. The output of the second comparator will cause pin 4 of the NAND gate IC17B of the monostable multivibrator to make a high-to-low transition. This, in turn, will cause the R-S flip-flop of the second detection circuit 43a to reset which turns off the light-emitting diode LED3 and turns on the transistor Q18. Then, the output of the operational amplifier IC18A will drop to zero volts at time t6. Consequently, the output of the second comparator will return to the high logic level at time t7. At the time t5, the transistor Q17 will also be turned on so as to light the light-emitting diode LED4 indicating that the print head clutch 46 is to be engaged. A negative pulse will be further generated from the second clutch control circuit 36a for activating again the opto-isolator network 47. The network 47 will thus energize the print head clutch 46 so as to cause engagement of the print head motor 44 with the print head 48 and printing will occur again.

The operation of the first and second print placement networks 31, 31a will operate alternately in response to the alternate input signals as determined by the steering circuit 64. In this manner, the second print placement network will determine the placement of the print in response to the second input signal even when the integrator in the first print placement network is busy. Further, printing can be placed almost anywhere on the products without changing the remote sensor location and over a wide range of print registration and conveyor speed without encountering a "dead space" where printing cannot be placed.

For completeness in the disclosure of the abovedescribed system but not for purposes of limitation the following representative values and component identifications are submitted. These values and components were employed in a system that was constructed and tested and which provides high quality performance.

| PART | TYPE OR VALUE |
|---|---|
| IC7A-IC7C, IC3A-IC8D, IC18A-IC18B | LM324 Op Amp |
| IC5A-IC5D, IC15A-IC15D, IC17A-IC17D | 4093 NAND Gate |
| IC16 | 4027 J-K flip-Flop |
| IC6 | MOC8030 Optical Isolator |
| Q6, Q8, Q9, Q10, Q16, Q17, Q18 | 2N5209 |
| Q7 | TIP127 |
| LED1-LED4 | 555-3006 |
| VR1-VR3 | 100K, 20 Turn |
| VR4 | 10K, 20 Turn |
| VR5 | 50K, 20 Turn |
| D1, D24, D6 | IN5265 |
| D2-D5, D7, D25-D28 | IN4005 |
| R50 | 9.1K |
| R51, R52, R131, R132 | 68K |
| R53, R54, R129, R130, R56, R126, R133, R42, R123, R56, R68 | 10K |
| R55, R60, R58-R60, R61, R62, R63, R69, R67, R66, R128, R65, R41 R49, R125, R45, R49, R128 | 100K |
| R48, R64 | 1K |
| R124, R44 | 15K |
| R127, R57 | 270K |
| R43a, R43b | 470K |
| R46, R47 | 4.7K |
| R39 | 220K |
| C14, C47 | .47uf |
| C41, C42, C11 | .01uf |
| C12, C43, C16, C45, C40, C15, C46, C44, C13 | .1uf |

From the foregoing detailed description, it can thus be seen that the present invention provides an improved position sensor system for controlling accurately the movement of a print head so that printing occurs on a series of products at the same location independent of conveyor speed, changes in speed and mechanical delays. Further, there is provided a position sensor system which includes first and second print placement networks which are responsive to alternate input signals so as to determine the placement of the print while the other one is busy.

While there has been illustrated and described what is at present considered to be preferred embodiments of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiments disclosed as the best modes contemplated for carrying out the invention, but that the invention will include all embodiments falling within the scope of the appended claims.

What is claimed is:

1. In a position sensor system used with a printing apparatus for controlling accurately the movement of a print head so that printing occurs on a series of products at the same location independent of product speed, changes in speed and mechanical delays, the improvement comprising:

sensing means for detecting the presence of a product or product mark on each product to be printed upon to generate input signals;

speed sensing means for detecting the speed of the product to be printed upon to generate a speed signal;

integrator means responsive to said speed signal and said input signals for generating a ramp signal indicative of the actual position of the product to be printed upon; and comparator means for comparing said ramp signal with a reference signal compensating for mechanical delays and for generating a clutch-on signal to activate a printing head clutch to cause movement of the print head into a printing position.

2. In a position sensor system as claimed in claim 1, wherein said integrator means comprises a first operational amplifier having an inverting input and an output, a capacitor connected between the inverting input and the output of said operational amplifier, an input resistor having one end connected to the inverting input and the other end coupled to receive the speed signal, and a transistor having an emitter and collector connected between the inverting input and the output of said operational amplifier, said base of said transistor being responsive to said input signals.

3. In a position sensor system as claimed in claim 2, further comprising print registration means coupled between said speed sensing means and said integrator means for adjusting the location of the printing on the product to be printed upon.

4. In a position sensor system as claimed in claim 3, further comprising web speed compensation means responsive to said speed signal for generating said reference signal compensating for the mechanical delays.

5. In a position sensor system as claimed in claim 4, wherein said comparator means comprises a second operational amplifier having a first input connected to receive said ramp signal via a first resistor and a second input connected to receive said reference signal via a second resistor, the output of said second operational amplifier producing said clutch-on signal.

6. In a position sensor system as claimed in claim 5, wherein said speed sensing means comprises a tach generator.

7. A position sensor system for controlling the movement of a print head so that printing occurs on a series of products at the same location, comprising:

sensing means for detecting the presence of a product or product mark on each product to be printed upon to generate input signals;

speed sensing means for detecting the speed of the product to be printed upon to generate a speed signal;

steering circuit means responsive to said input signals for generating alternately first enable signals corresponding to a first one of the alternate ones of said sensed signals and second enable signals corresponding to a second one of the alternate ones of said sensed signals;

first print placement circuit means responsive to said first enable signals and said speed signal for generating a first clutch-on signal to activate a print head clutch to cause movement of the print head into a printing position; and second print placement circuit means responsive to said second enable signals and said speed signal for generating a second clutch-on signal to activate the print head clutch to cause movement of the print head into the printing position.

8. A position sensor system as claimed in claim 7, wherein said first print placement circuit means includes first integrator means responsive to said speed signal and said first enable signals for generating first ramp signals indicative of the actual position of certain ones of the products to be printed upon.

9. A position sensor system as claimed in claim 8, wherein said second print placement circuit means includes second integrator means responsive to said speed signal and said second enable signals for generating second ramp signals indicative of the actual position of certain other ones of the products to be printed upon even when said first ramp signals are still being generated.

10. A position sensor system as claimed in claim 9, wherein said first integrator means comprises an operational amplifier having an inverting input and an output, a capacitor connected between the inverting input and the output of said operational amplifier, an input resistor having one end connected to the inverting input and the other end coupled to receive the speed signals, and a transistor having an emitter and collector connected between the inverting input and the output of said operational amplifier, said base of said transistor being responsive to said first enable signals.

11. A position sensor system as claimed in claim 10, wherein said second integrator means comprises an operational amplifier having an inverting input and an output, a capacitor connected between the inverting input and the output of said operational amplifier, an input resistor having one end connected to the inverting input and the other end coupled to receive the speed signals, and a transistor having an emitter and collector connected between the inverting input and the output of said operational amplifier, said base of said transistor being responsive to said second enable signals.

12. A position sensor system as claimed in claim 7, wherein said speed sensing means comprises a tach generator.

13. A position sensor system as claimed in claim 7, wherein said steering circuit means comprises a J-K flip-flop having a $\overline{Q}$ output for providing said first enable signals and a Q output for providing said second enable signals.

14. A position sensor system as claimed in claim 7, further comprising print registration means coupled between said speed sensing means and said first and second print placement circuit means for adjusting the location of the printing on the product to be printed upon.

15. A position sensor system as claimed in claim 9, wherein said first print placement circuit means further comprises first comparator means for comparing said first ramp signals with a reference signal.

16. A position sensor system as claimed in claim 15, wherein said second print placement circuit means further comprises a second comparator means for comparing said second ramp signals with the reference signal.

17. A position sensor system for controlling the movement of a print head so that printing occurs on a series of products at the same location, comprising:

sensing means for detecting the presence of a product or product mark on each product to be printed upon to generate input signals;

speed sensing means for detecting the speed of the product to be printed upon to generate a speed signal;

steering circuit means responsive to said input signals for generating alternately first enable signals corresponding to a first one of the alternate ones of said sensed signals and second enable signals corresponding to a second one of the alternate ones of said sensed signals;

first print placement circuit means responsive to said first enable signals and said speed signal for generating a first clutch-on signal to activate a print head clutch to cause movement of the print head into a printing position;

second print placement circuit means responsive to said second enable signals and said speed signal for generating a second clutch-on signal to activate the print head clutch to cause movement of the print head into the printing position; and actuating means including a print head clutch responsive to said first and second clutch-on signals for causing a print head motor to be engaged with the print head.

18. A position sensor system as claimed in claim 17, wherein said first print placement circuit means includes first integrator means responsive to said speed signal and said first enable signals for generating first ramp signals indicative of the actual position of certain ones of the products to be printed upon.

19. A position sensor system as claimed in claim 18, wherein said second print placement circuit means includes second integrator means responsive to said speed signal and said second enable signals for generating second ramp signals indicative of the actual position of certain other ones of the products to be printed upon even when said first ramp signals are still being generated.

20. A position sensor system as claimed in claim 17, wherein said steering circuit means comprises a J-K flip-flop having $\overline{Q}$ output for providing said first enable signals and a Q output for providing said second enable signals.

* * * * *